United States Patent [19]

Meredith

[11] Patent Number: 4,483,025

[45] Date of Patent: Nov. 20, 1984

[54] SNAP-ON GUTTER COVER FOR SWIMMING POOLS

[75] Inventor: David L. Meredith, Greensboro, N.C.

[73] Assignee: Swimout Overflow Components, Inc., Greensboro, N.C.

[21] Appl. No.: 180,700

[22] Filed: Aug. 25, 1980

[51] Int. Cl.[3] ..... E04H 3/16; E04H 3/18

[52] U.S. Cl. ..... 4/510; 4/508

[58] Field of Search ..... 4/496, 498, 503, 504, 4/506–512

[56] References Cited

U.S. PATENT DOCUMENTS

| | | | |
|---|---|---|---|
| 2,964,759 | 12/1960 | Riggs | 4/498 |
| 2,982,970 | 5/1961 | Kennedy | 4/511 |
| 3,908,207 | 9/1975 | van den Broek | 4/510 X |
| 3,968,527 | 7/1976 | Hough | 4/510 |
| 3,972,077 | 8/1976 | Whitten, Jr. | 4/510 X |
| 3,990,167 | 11/1976 | Whitten, Jr. | 4/510 X |
| 4,007,566 | 2/1977 | Molitor | 4/510 X |
| 4,084,272 | 4/1978 | Laven | 4/510 |

*Primary Examiner*—Henry K. Artis

*Attorney, Agent, or Firm*—Charles R. Rhodes; Judith E. Garmon

[57] ABSTRACT

A snap-on swimming pool gutter cover is formed of a generally planar major portion including a rear edge and an inverted, channel-shaped, front, female portion which snaps down onto a correspondingly shaped male portion of the gutter lip. The rear edge is received in a horizontal slot in the rear wall of the gutter.

3 Claims, 3 Drawing Figures

SNAP-ON GUTTER COVER FOR SWIMMING POOLS

BACKGROUND OF THE INVENTION

During recent years the construction of swimming pools has altered dramatically. Years ago, it was recognized that gutters around the upper edge of pools would dispose of overflow water, as well as skimming off with the overflow water most of the contaminants in the pool such as bacteria, oils and debris. In the early days such gutters were formed or cast of concrete which became a permanent, integral portion of the upper side walls of the pool. As such, the gutters had to be torn apart to gain access to the drainage portion which obviously leads to expensive and time consuming maintenance procedures.

In more recent years, gutters have been prefabricated from other materials such as steel or plastics. These gutters are attached to the upper edge of the concrete portion of the wall of the pool, and can be removed and replaced without destruction of the gutter or damage to the side wall. Such gutters provide not only for the skimming of the pool overflow but also, in some cases, provide for the introduction of fresh water into the pool.

With such gutters it is commonplace to provide a slotted or perforated cover for several purposes. First of all the gutter cover keeps larger debris such as sticks and leaves out of the drainage system and out of the gutter proper. Also the gutter covers provide a safety feature in that bathers can step into and out of the pool by way of the gutter covers, rather than having to avoid the treacherous gutter trough which is recessed below the pool deck and upper lip of the gutter. As such, the gutter trough provides a dangerous safety hazard unless the cover is provided. Covers known to the applicant fall within one of two types. Either they are secured by hardware to the upper edge of the gutters, so that where the gutter cover must be removed, the operation is time consuming and often requires special tools. See U.S. patents to Molitor U.S. Pat. No. 4,007,566; Hough U.S. Pat. No. 3,968,527; and Laven U.S. Pat. No. 4,084,272. The other type of gutter cover is merely a flat member which lies on a pair of spaced ledges, and is easily dislodged or removed by vandals. See U.S. patent to Whitten, Jr. U.S. Pat. No. 3,990,167.

SUMMARY OF THE PRESENT INVENTION

The present invention, on the other hand, provides a snap-on cover which may be releasably and securely snapped into place over the gutter lip and into a recess in the rear wall of the gutter. While the cover is securely attached to the gutter, it is easily removed by workmen who understand the proper removal techniques. Assembly and removal of the gutter of the present invention may be accomplished with a simple special tool.

In its broadest sense the gutter cover of the present invention is of the snap-on type in which a front portion fits down over the gutter lip or over a protrusion attached to the gutter lip, and the rear edge fits into some type of receiving means which is built into the rear wall of the gutter. Preferably the receiving means is a horizontal slot into which the rear edge slides. Then the front portion, which is preferably an inverted channel-shaped member, fits down over a cylindrical member attached to the upper lip of the gutter. The dimensions of the inverted channel shape member are such that a snap fit over the cylindrical member or pipe is effected. Such a snap fit prevents either vertical or horizontal movement of the cover by the combination of the rear edge being received in the slot and the front channel snapping over the lip.

So arranged, the gutter cover is easily installed and easily removed. It remains in place despite swimmers walking on the cover or climbing out of the pool by using the gutter as a hand hold. The gutter cover of the present invention is a molded, integral member formed of a substantially rigid polymeric material such as polyvinyl chloride.

It is therefore a primary object of the present invention to provide a snap-on cover for swimming pool gutters, which cover can be easily installed and removed, and is held firmly in place during use.

Other objects and a fuller understanding of the invention will become apparent upon reading the following detailed description of a preferred embodiment, along with the accompanying drawings in which.

DETAILED DESCRIPTION OF A PREFERRED EMBODIMENT

Figure 1:
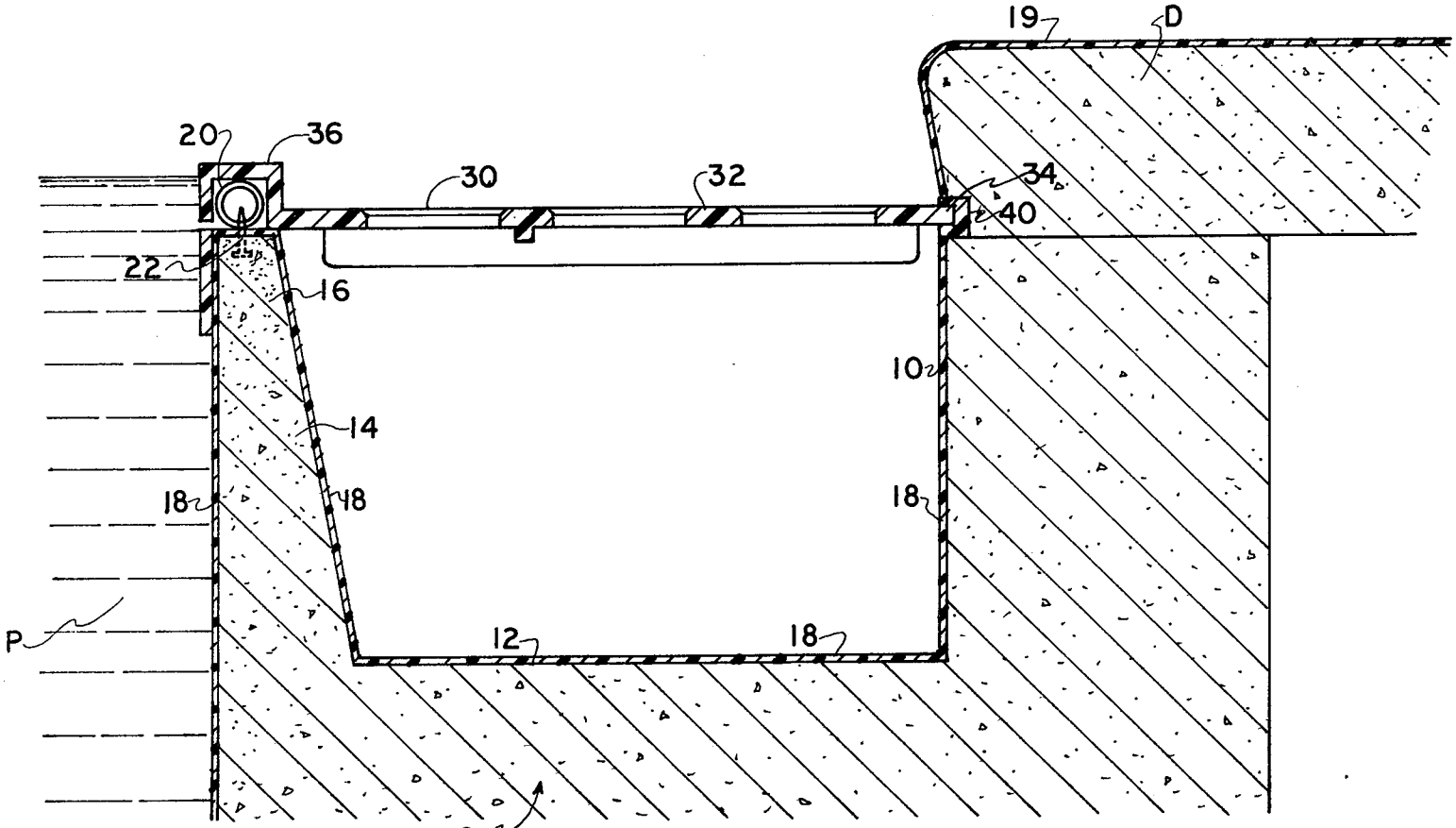
FIG. 1 is a sectional view of a swimming pool gutter having the cover of the present invention attached thereto.

Turning now to the drawings, and first of all to FIG. 1, there is illustrated a portion of the swimming pool P in which the concrete deck D is provided with a relatively conventional gutter construction G. The deck D and gutter channel G may be formed or cast from a concrete material with no covering. However, if desired, a plaster coating 18 may cover the concrete portion of the pool surface and gutter. In indoor installations the deck edge is preferably covered with tile 19. The U-shaped gutter G includes a rear wall 10, bottom wall 12, and front wall 14 which separates the water in the pool P from the gutter G. The front wall 14 terminates in an upper lip 16 at a level substantially beneath the upper extent of the deck D so that overflow water in the pool will flow over the gutter lip; however, waves are deflected by the inner edge of deck D and the water is retained in the gutter G until drainage. The gutter itself may be formed of concrete integral with the walls of the pool, or it may be separably fabricated and laid onto the prepared concrete wall base in a conventional technique.

Figure 2:
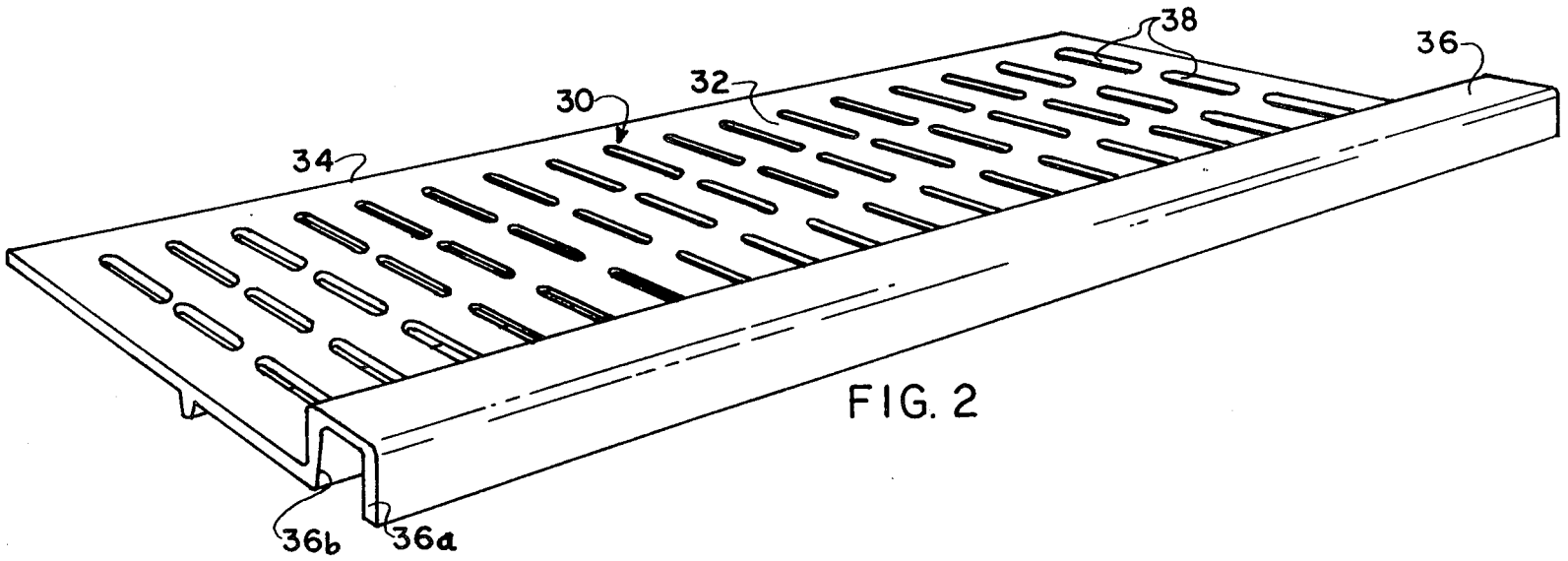
FIG. 2 is a perspective view looking at the top of a gutter cover segment according to the present invention.
Figure 3:
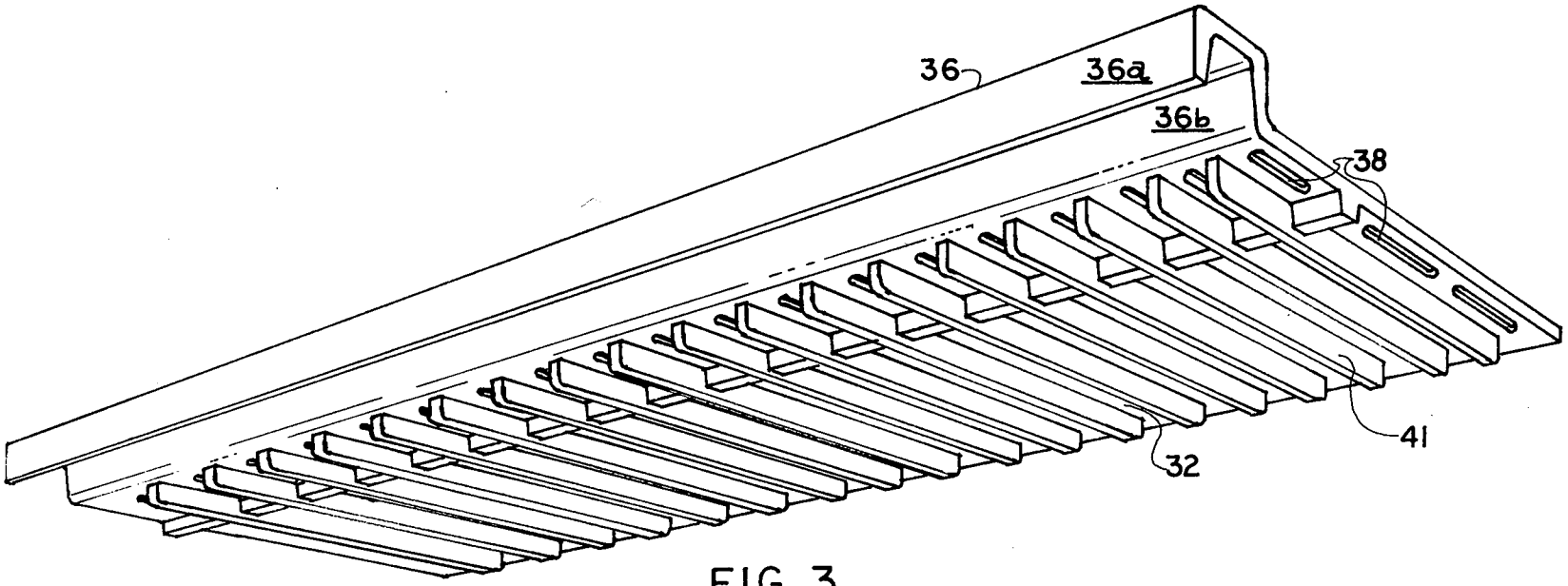
FIG. 3 is a perspective view looking at the bottom of the gutter cover segment of FIG. 2.

The gutter cover construction which forms the present invention includes a plurality of gutter cover segments laid end to end atop the gutter around the pool. Each cover member or segment 30 includes a generally planar major portion 32, a rear edge 34, and a front portion 36. The front portion 36, as best illustrated in FIGS. 2 and 3 is formed in the shape of an inverted channel extending forwardly from the planar portion and including a front wall **36*a* and a rear wall 36*b*** spaced from each other.

Further, there is provided means for releasably securing the inverted channel shaped member onto or atop the lip 16 in such a manner as to prevent inadvertent horizontal movement of the cover. While the inverted channel shaped member 36 might be shaped corresponding to the configuration of the upper portion 16 of front wall 14 so that it slides down thereonto, in a preferred embodiment the construction is somewhat different. Preferably there is provided a cylindrical member such as a pipe 20 secured to the upper edge of lip 16 around the edge of the pool by means of one or more fasteners 22 which extend through the pipe wall and are embedded in lip material. Therefore the pipe is first secured to the lip 16. The inverted channel shaped member is then snapped onto the pipe or cylindrical member 20. Obviously to effect this snap type assembly, the inner dimensions between front wall 36*a* and rear wall 36*b* should closely correspond to the outer dimensions of pipe 20. Whether or not any water runs beneath the cover and over the lip 16 into the gutter G is immaterial.

At the rear edge 34, there is provided a retaining means 40 for releasably receiving the aforementioned rear edge of the cover member and preventing inadvertent vertical movement thereof. The retaining means 40 is preferably a separate, molded, channel-shaped strip having a groove therein of a width at least as wide as the corresponding thickness of the rear edge 34 of cover 30; however, not appreciably greater than such thickness so that the rear edge will be snugly received therein. Additionally, the groove in channel member 40 should be of such depth that, when assembled, and the weight of a person is placed on the cover member 30, the deformation of the polymeric material will not be such as to allow the rear edge 34 to slip out of the groove 40. In the configuration illustrated in FIG. 1 the receiving means 40 should be approximately level with the upper edge of lip 16, so that the main body portion 32 is substantially horizontal. Of course, if the front portion 36 of cover member 30 is going to fit down over the lip 16, the receiving means 40 should be substantially lower on rear wall 10.

Alternate approaches to the receiving means 40 include merely cutting or forming a suitable groove in the concrete rear wall in situations where the gutter is formed entirely of concrete. Alternately, there might merely be left a space between the tile 19 coming down over the edge of the deck D or the deck lip itself and the upper edge of the rear wall 10 or the coating 18 thereof. This space or groove would then receive the rear edge 34.

While a preferred embodiment of the present invention has been described in detail hereinabove, it is obvious that various changes and modifications might be made without departing from the scope and intent of the invention which is set forth in the following claims.

What is claimed is:

1. A gutter cover construction for swimming pools of the type having a U-shaped gutter channel extending around the upper edge thereof into which overflow water spills, said gutter channel having a rear wall, a bottom wall, and a front wall separating the water in the pool from the gutter, said front wall terminating in an upper lip at a level beneath the upper extent of said rear wall, said gutter cover construction comprising:

(a) a cover member including a generally planar major portion, a rear edge, and a front portion;

(b) said front portion including an inverted substantially open channel shaped member extending forwardly from said planar portion;

(c) means associated with the lip of said gutter channel for releasably receiving said inverted channel shaped member thereon and preventing horizontal movement thereof;

(d) retaining means in said rear wall for releasably receiving said rear edge of the cover member and preventing vertical movement thereof;

(e) whereby said gutter cover may be assembled, held securely in place, but easily removed.

2. The gutter cover according to claim 1 wherein said means for releasably receiving said inverted channel shaped front portion includes a cylindrical member attached to the top of said lip and extending therealong, said cylindrical member being of an outer diameter substantially the same as the inner dimensions of said inverted channel-shaped member.

3. The gutter cover according to claim 1 wherein said retaining means in said rear wall includes a horizontal slot in said rear wall, said slot being of a depth sufficient to retain said cover in place and of a thickness at least as great as the corresponding thickness of said cover member.

* * * * *